US007805892B2

(12) United States Patent
Neumann et al.

(10) Patent No.: US 7,805,892 B2
(45) Date of Patent: Oct. 5, 2010

(54) REFRIGERATOR AND/OR FREEZER

(75) Inventors: Günter Neumann, Ochsenhausen (DE); Werner Schad, Schemmerhofen (DE); Dorner Georg, Steinhausen (DE); Josef Hecht, Erlenmoos (DE)

(73) Assignee: Liebherr-Hausgerate Lienz GmbH, Lienz (AT)

( * ) Notice: Subject to any disclaimer, the term of this patent is extended or adjusted under 35 U.S.C. 154(b) by 567 days.

(21) Appl. No.: 11/791,628

(22) PCT Filed: Nov. 29, 2005

(86) PCT No.: PCT/EP2005/012746

§ 371 (c)(1),
(2), (4) Date: May 24, 2007

(87) PCT Pub. No.: WO2006/058707

PCT Pub. Date: Jun. 8, 2006

(65) Prior Publication Data

US 2008/0093957 A1 Apr. 24, 2008

(30) Foreign Application Priority Data

| | | |
|---|---|---|
| Nov. 29, 2004 | (DE) | 20 2004 018 464 U |
| Dec. 23, 2004 | (DE) | 20 2004 019 866 U |
| Jan. 20, 2005 | (DE) | 20 2005 000 923 U |

(51) Int. Cl.
*E06B 3/00* (2006.01)

(52) U.S. Cl. ..... 52/28; 52/208; 52/204.5; 52/204.593; 52/204.1; 52/204.6

(58) Field of Classification Search ..... 52/28, 52/208, 173.1, 204.1, 204.5, 204.593, 204.6; 312/116, 138.1, 405
See application file for complete search history.

(56) References Cited

U.S. PATENT DOCUMENTS

| | | | | |
|---|---|---|---|---|
| 4,640,078 | A * | 2/1987 | Haffer | 52/844 |
| 4,897,975 | A * | 2/1990 | Artwick et al. | 52/208 |
| 5,699,676 | A * | 12/1997 | Trulaske, Sr. | 62/264 |
| 5,910,083 | A * | 6/1999 | Richardson et al. | 52/171.1 |
| 6,655,760 | B1 * | 12/2003 | Sakata et al. | 312/116 |
| 6,698,154 | B2 * | 3/2004 | Vance | 52/716.6 |

FOREIGN PATENT DOCUMENTS

| | | |
|---|---|---|
| DE | 3716914 | 11/1988 |
| EP | 0953807 | 11/1999 |

* cited by examiner

*Primary Examiner*—Brian E Glessner
*Assistant Examiner*—Patrick Maestri
(74) *Attorney, Agent, or Firm*—Dilworth & Barrese LLP

(57) ABSTRACT

A refrigerator and/or freezer is provided with a glass door having a metal frame in which a glazing is inserted, the metal frame forming an outer skin of the door, which with a front-side portion and a narrow-side portion covers the front and circumferential sides of the glazing and forms the visible sides of the door, a circumferential glazing holder being connected with the outer skin. The outer skin is composed of a circumferentially integral one-piece metal casing, which on the visible sides of the door is formed without a seam, and the glazing holder is foamed into a circumferential foam body with which the metal casing is circumferentially foam-backed on its rear side.

20 Claims, 4 Drawing Sheets

REFRIGERATOR AND/OR FREEZER

BACKGROUND OF THE INVENTION

The present invention relates to a refrigerator and/or freezer with a glass door having a metal frame in which a glazing is inserted. Refrigerators in accordance with the present application can also be climatic cabinets for storing in particular wine.

Previous glass doors of refrigerators are disadvantageous in several respects. As far as their metal frame consists of extruded aluminum profiles, which are mitered and put together, gaps resulting from tolerances at the junction points are inevitable. Additional applications such as locks, viewing windows and the like can hardly be incorporated in the extruded profiles. In addition, the contour of the metal frame is more or less predetermined by the frame profiles and can at best slightly be adapted by additional machining.

SUMMARY OF THE INVENTION

As far as the frame of glass doors is constructed from extruded plastic profiles and/or injection molded parts by welding or plugging together, a high-quality optical appearance regularly is not achievable. Welding results in visible points of abutment. In addition, a uniform color or surface mostly cannot be achieved by the combination of various plastic parts.

Therefore, it is the object underlying the present invention to create an improved refrigerator and/or freezer, which avoids the disadvantages of the prior art and develops-the-latter in an advantageous way. In particular there should be created a glass door of high-quality optical appearance with sufficient stability.

In accordance with the invention, this object is solved by a refrigerator and/or freezer as described herein. Preferred aspects of the invention are also described herein.

In accordance with the invention, the metal frame surrounding the glazing thus is not composed of several pieces. It consists of a metal casing circumferentially integrally formed in one piece, which at least on the visible side of the door is formed without a seam. In this way, a homogeneous optical appearance is realized, which has not been achieved so far. Color deviations, visible gaps or points of abutment have been eliminated. The outer skin of the door consists of a completely uniformly produced and aligned material. To nevertheless achieve the necessary stability, the metal casing can be foam-backed or foam-filled circumferentially with a foam body. As a result, the integral one-piece metal casing can be designed in a substantially greater number of variants and in almost any desired way regardless of the usual stability requirements of the metal frame.

In particular, the integral one-piece metal frame consists of a chiplessly formed sheet profile, which can be fabricated from a one-piece sheet bar and can have a central punched-out recess for the glazing. Preferably, the metal casing is deep-drawn. Alternatively or in addition, it can be bent and beaded. Non-bent or non-beaded marginal webs can be welded at points of abutment in the unvisible region.

The inside of the metal casing is connected with the foam body over its surface, preferably over its entire surface. In particular when the metal casing has flanks inclined with respect to each other in cross-section, foam-backing can provide a considerable stiffening. The dimensional accuracy of the metal casing is improved considerably by foaming. At the same time, foam-backing the metal casing considerably improves the heat transfer coefficient, the so-called "K value" of the profile. Moreover, the foam body provides a distinct reduction of the formation of condensate on the frame and of the transition to the glazing. Even without heating, the metal frame can be kept largely free from condensate.

On its front side, the metal casing can be provided with various contours. According to an advantageous embodiment of the invention, the metal casing has a front side which is bulged across the width and/or height of the door. Apart from a dynamic optical appearance, the door thereby obtains an increased rigidity in itself. The curvature is not restricted to a curvature in cross-section, as it could also be obtained in extruded profiles. Rather, the upper and lower transverse legs of the metal frame are curved on their front side in longitudinal direction of the transverse legs, i.e. the entire front side of the metal casing is slightly curved about a substantially vertical axis of curvature, whereby the metal casing plastically stands out from the planar glazing.

To achieve a precise, sharp-lined optical appearance also at the transition to the glazing, the metal casing can have a glazing cut-out in which a circumferential one-piece cover frame is inserted. The cover frame can circumferentially rest against the edge of the metal casing defining the glazing cut-out, and in particular it can be plugged onto said edge, which preferably extends substantially parallel to the glazing plane, with a circumferential groove, so that the edge of the metal casing is enclosed by the cover frame on both sides. The cover frame preferably is formed in one piece with a slight oversize with respect to the glazing cut-out. By elastic deformation, it nevertheless can be inserted in the glazing cut-out.

Advantageously, the cover frame is formed without a gap on the front side and also terminates largely gap-free at the glazing, whereby lines of dirt are avoided and a perfect optical appearance is ensured for a long time.

If the metal casing has the camber described above across the entire width of the door, said cover frame can have a changing depth, in order to compensate the curvature of the front side of the metal frame with respect to the planar glazing.

Advantageously, the glazing cut-out of the metal casing can be angular. In contrast to a rounded glazing cut-out, a sharp, precise optical appearance is achieved here.

It is to be understood, however, that such angular glazing cut-out need not necessarily be provided. In accordance with an alternative embodiment of the invention, a rounded glazing cut-out can also be incorporated in the metal casing.

It is thus possible in particular to provide the metal casing towards the glazing cut-out with a marginal web which is angled with respect to the front side of the metal casing. Such angled marginal web effects a stiffening of the metal casing in itself, which provides the door with a higher strength.

To provide for a compensation of tolerances between the glazing and the metal casing, an elastic seal can be interposed. In principle, the same can be provided on the front side of the glazing, in particular when the above-described angled marginal web is used. To achieve a precise optical appearance from outside, which is not disturbed by the sometimes unsightly rubber bead of the seal, the compensation of tolerances is shifted, however, to the inside. On its front side, the glazing can abut directly at the edge of the metal casing defining the glazing cut-out or at the above-described cover frame inserted therein. The elastic seal for the compensation of tolerances is provided on the back.

The glazing can be mounted to the metal frame in various ways. In accordance with a development of the invention, a glazing holder is provided for the glazing, which can be attached to the frame reinforcement. If the above-described foam filling is provided, the glazing holder can be foamed into the foam body.

Advantageously, the glazing holder has supporting legs protruding from the metal frame to the inside, on which the glazing rests with the flat side thereof. Between the supporting leg and the glazing a suitable connection is provided expediently. In particular, the glazing can be adhered to the supporting leg. By bonding the glass with these parts, the door obtains its final rigidity.

To achieve a good thermal insulation, the glazing is a multiple glazing in accordance with a development of the invention, in which a plurality of glass panes are arranged at a distance from each other. In accordance with one embodiment of the invention, three glass panes can be provided, which are connected with each other by circumferential spacers provided on the edge.

In accordance with a development of the invention, an elastic lip seal is provided between the metal casing and the glazing and/or between the glazing holder and the glazing, which encloses the glazing and with its elastic lip compensates changes in thickness of the glazing. On the one hand, this prevents the entrance of moisture. On the other hand, a neat termination is created.

The elastic seal can have portions of different hardness and/or flexibility. In particular, a soft sealing lip can be molded on a harder fastening portion. For this purpose, the seal can be injection-molded of different plastic materials by a two-component method. It is also possible to mold on a softer sealing lip by coextrusion. Advantageously, the seal cannot only seal the glazing, but at the same time assume a supporting function for the glazing.

To illuminate the door, an illumination means can be provided on the metal frame, which conducts light into the glazing. For this purpose, light emitting diodes or fluorescent tubes can be provided in the region of transition between the metal frame and the glazing. A separate illumination of the apparatus interior possibly can be omitted thereby. Further additional applications, such as a frame heating, can be provided inside the metal casing.

Should the door be lengthened towards the body of the apparatus above and/or below its seal, so as to for instance cover or protrude beyond the apparatus, additional parts, in particular door extensions, can be attached to the metal frame, which then possibly can also accommodate additional components such as a lock or thermometer.

BRIEF DESCRIPTION OF THE DRAWINGS

The invention will subsequently be explained in detail with reference to preferred embodiments and associated drawings, in which.

DESCRIPTION OF THE PREFERRED EMBODIMENTS

Figure 1:
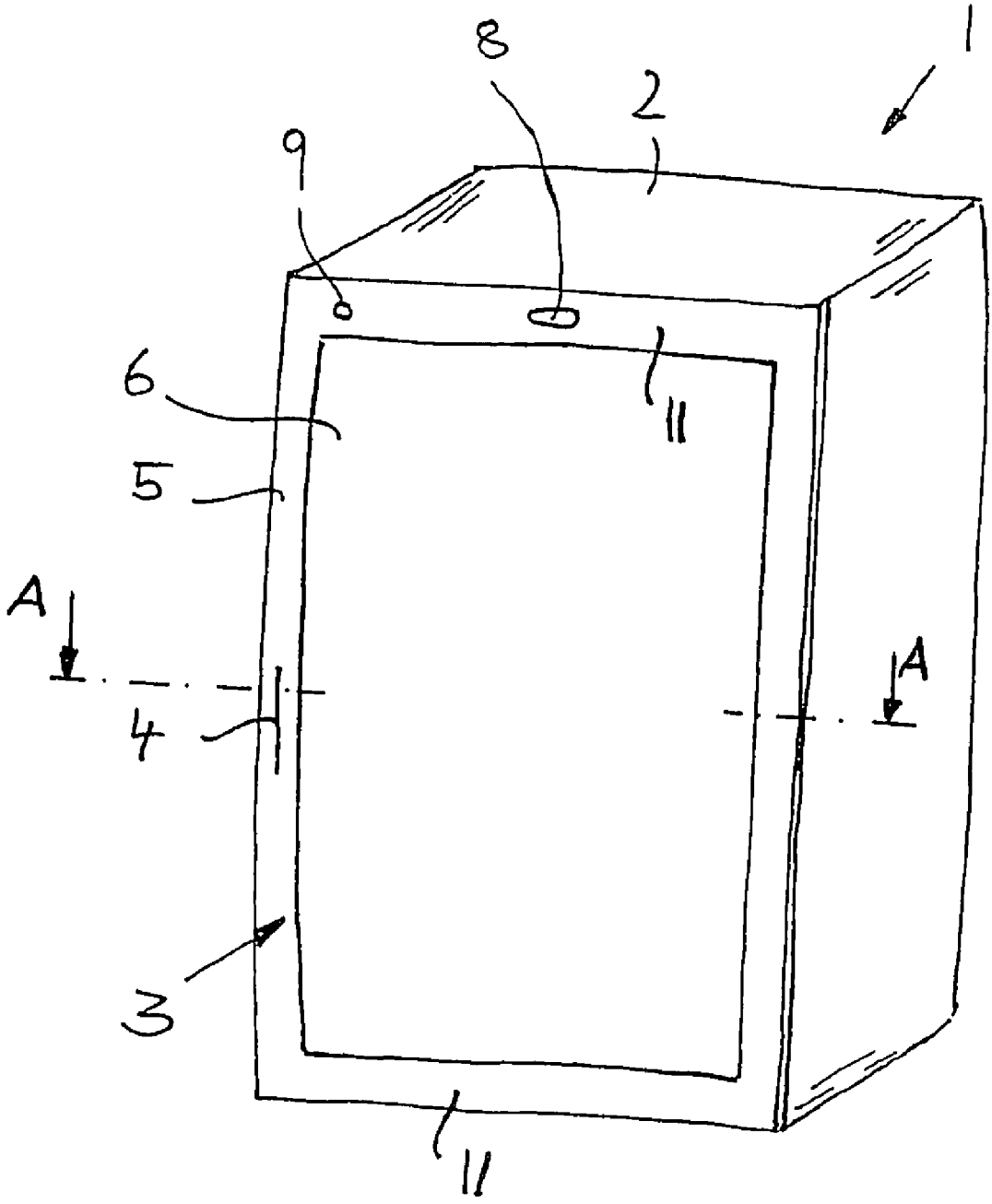
FIG. 1: shows a perspective view of a refrigerator with a glass door according to a preferred embodiment of the invention in a schematic representation.

The refrigerator 1 shown in FIG. 1 has a substantially cubic apparatus body 2, which itself is open on the front side and can be closed by a door 3. In a manner known per se, the door 3 is pivotally mounted on the apparatus body 2 about a vertical door swivel axis, so that it can be swiveled open and closed by means of a door handle 4 about the swivel axis located on the right in FIG. 1.

Figure 2:
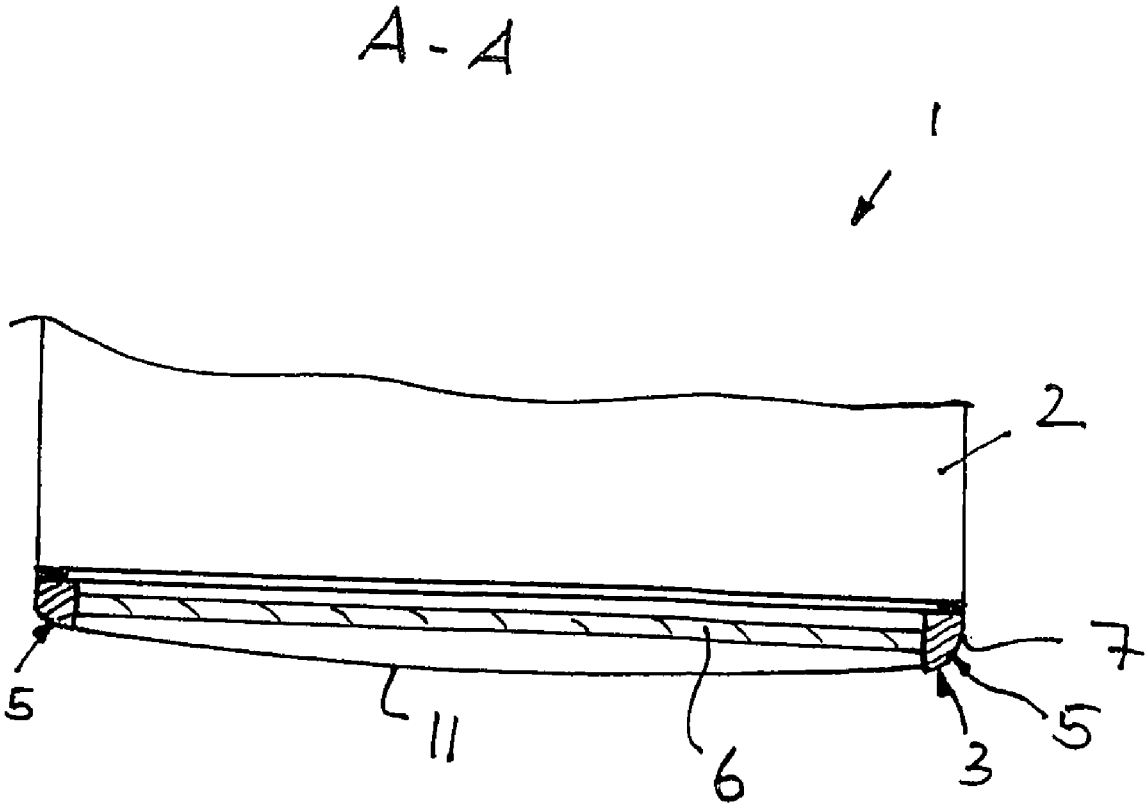
FIG. 2: shows a sectional view of the glass door of the refrigerator of FIG. 1 along line A-A in FIG. 1, FIG. 3: shows a sectional view of the glass door of FIG. 1 according to a preferred embodiment of the invention, in which the metal casing is foam-filled.

As shown in detail in FIG. 2, the door 3 constitutes a glass door, which has a metal frame 5 in which a glazing 6 is inserted. In such glass doors, the metal frame regularly is formed rather narrow. The glazing 6 regularly takes up more than ⅔ of the width or height of the door.

The metal frame 5 consists of a circumferentially integral one-piece metal casing 7, which is fabricated of one piece, in particular of a one-piece sheet bar, in a chipless forming process. In particular, the metal casing 7 can be deep-drawn or bent and beaded. Advantageously, the metal casing 7 thereby has no seams or points of abutment, at least on its visible front side shown in FIG. 2, as this is the case in conventional metal glass doors, which are composed of a plurality of metal frame pieces.

In the vicinity of the upper transverse piece of the metal frame 5, punched-out recesses for a thermometer 8 and a lock 9 are incorporated in the metal casing 7.

In a beaded version of the metal casing 7, covers can be mounted on the end face, in order to conceal the sheet edges and the support and improve the optical appearance.

For sealing the door 3 against the apparatus body 2, a seal 14 is circumferentially seated on the back of the metal frame 5 around the glazing 6, which seal is urged against the apparatus body 2 when the door is closed.

In case the door 3 should be lengthened above and/or below the seal 14, in order to, for instance, cover or protrude beyond the apparatus, additional parts can be incorporated, which then can possibly accommodate the additional components such as the lock 9 or the thermometer 8.

As shown in FIG. 2, the metal casing 7 is formed with a slight camber on its front side across the entire width of the door. The upper and lower transverse legs 11 are slightly curved along their length, i.e. from the left to the right as shown in FIG. 1. The resulting difference with respect to the planar glazing 6 is compensated either by a cover frame inserted in the glazing cut-out or by marginal webs of the metal casing, which are angled with respect to the front side, as will be described in detail.

Figure 3:
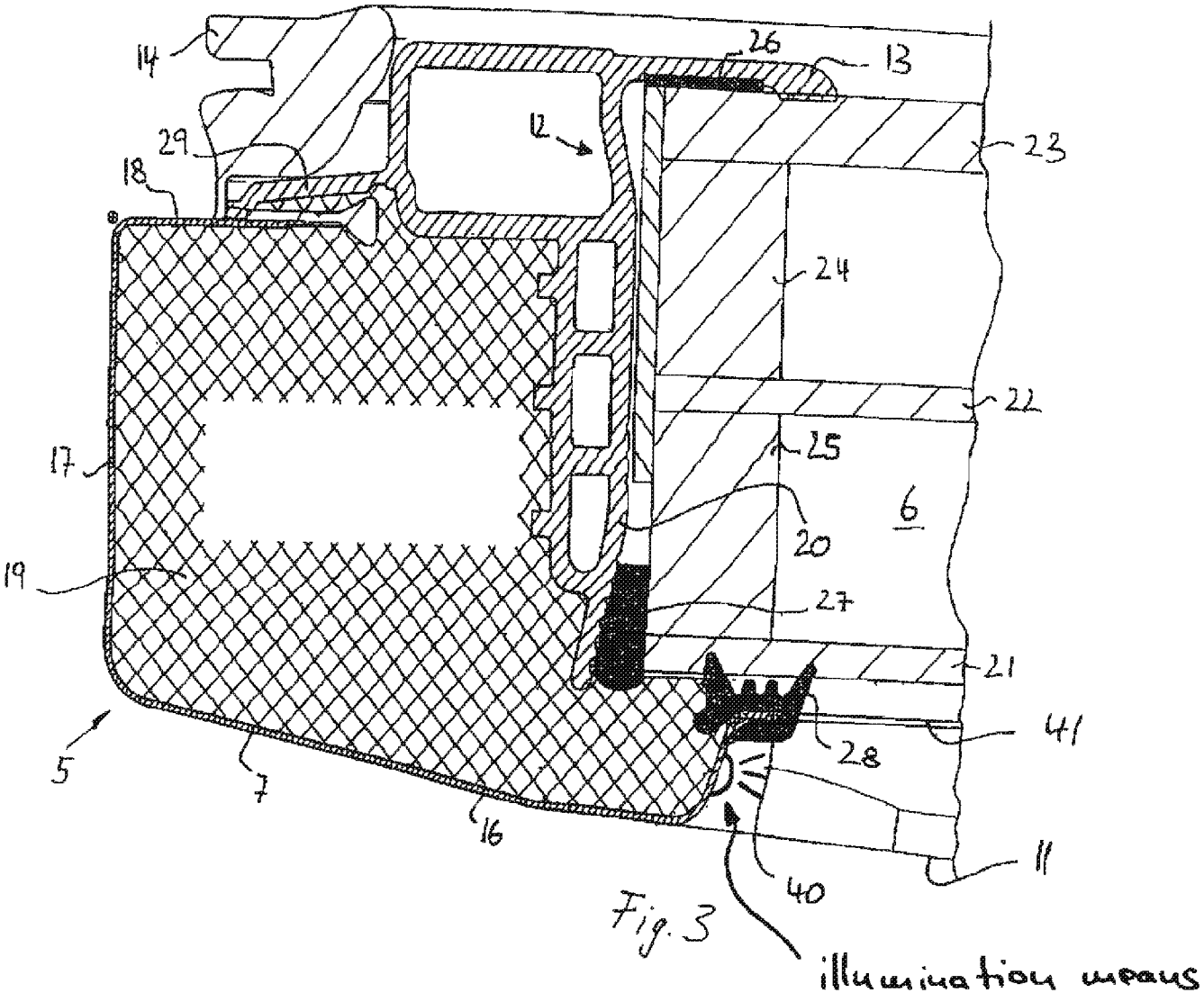

As shown in FIG. 3, the metal casing 7 has been formed chiplessly to obtain the desired cross-sectional contour, so that the metal casing 7 comprises a front-side portion 16, a narrow-side portion 17 as well as a rear-side portion 18. The rear-side cavity thus defined by the metal casing 7 is foam-filled, so that a circumferential foam body 19 fully rests against the rear-side wall of the metal casing 7 and forms a closed frame reinforcement which considerably improves the dimensional accuracy of the metal casing. It should be appreciated that foam backing the metal casing 7 also provides an improved thermal insulation. The metal frame 5 has a substantially improved K value.

As shown in FIG. 3, a glazing holder 12 is foamed into the foam body 19, which on the one hand has the inwardly protruding supporting leg 13 for the glazing 6 and a terminating leg 20 angled with respect thereto in an L-shaped manner. The profile used as glazing holder 12 defines the foam body 19 with respect to the open side of the metal frame 5 not defined by the metal casing 7.

The glazing 6 consists of a triple glazing comprising three glass panes 21, 22, 23, which are arranged parallel to each other and are connected with each other by spacers 24 and 25. The spacers 24 and 25 advantageously extend all around, so that a generally closed insulating glass package is obtained. The glazing 6 is inserted into the glazing holder 12 and can be attached there to the supporting leg 13 by a bond 26. With respect to the limiting leg 20, the glazing 6 is sealed by a circumferential seal 27.

The glazing holder 12 with the glazing 6 inserted therein is inserted from the rear into the open side of the metal casing 7, wherein the edge of the central punched-out recess of the metal casing 7 for the glazing 6 is sealed and terminated neatly by a further seal 28, which is seated on the edge of the metal casing 7. Upon inserting the glazing with the glazing holder 12 provided thereon, the cavity formed on the back in the metal casing 7 is foam-filled, so that the glazing holder 12 is foamed into the foam body 19. As shown in FIG. 3, the glazing holder 12 comprises a supporting portion 29 which rests on the rear-side leg portion 18 of the metal casing 7. On this supporting portion 29, the door seal 14 is mounted, which seals the door 3 with respect to the supporting body 2.

As shown in FIG. 3, the edge of the metal casing 7, which defines the glazing cut-out 41 of the metal casing, is angled towards the inside with respect to the front side of the metal casing 7, the last marginal web in turn being angled substantially parallel to the glazing plane. Due to the angled design of the marginal portion 40, the metal casing 7 obtains a considerably increased rigidity. The seal 28 is seated on the marginal web 40. It can be plugged onto the web circumferentially, the sealing lips of the seal 28 being supported on the front side of the glazing and providing for a compensation of tolerances. Here, not only manufacturing tolerances are important. Rather, the multiple glazing can change in thickness as a result of changes in pressure, for instance during transport at greater altitudes, so that a compensation of tolerances is necessary. In this embodiment of the glass door, the glazing cut-out 41 advantageously is not perfectly angular, but rounded, in order to provide for the formation of the marginal web.

Figure 4:
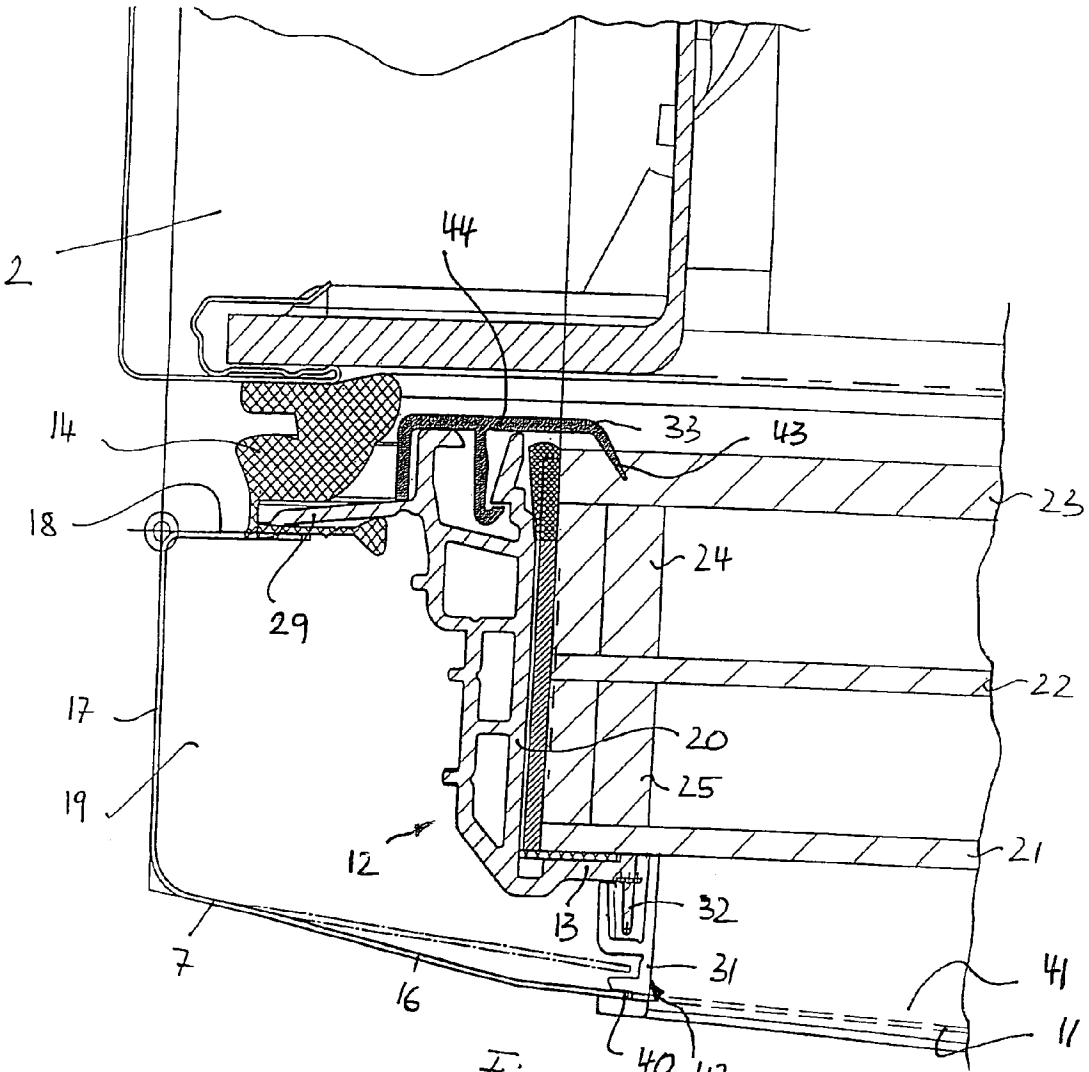
FIG. 4: shows a sectional view of a glass door similar to FIG. 3 according to a further preferred embodiment of the invention, in which the metal casing is foam-filled.

The embodiment as shown in FIG. 4 likewise comprises the metal casing 7 as shown in FIG. 2, which has a camber across the width of the door and is bent in cross-section and in whose central punched-out recess the glazing 6 with the glazing holder 12 mounted thereon is inserted. Here as well, the glazing holder 12 has a supporting portion 29 seated on the rear-side leg portion 18 of the metal casing 7. However, the glazing holder 12 is formed inverted, so to speak. The supporting leg 13, on which rests the glazing 6, extends at the front-side end of the terminating leg 20 of the glazing holder 12. Between the supporting leg 13 and the metal casing 7, a connection in the form of a cover frame 42 is provided, which constitutes a labyrinth seal, so to speak. A profile piece 31 forming the cover frame 42 is clampingly seated on the edge of the metal casing 7 adjoining the central punched-out recess and extends towards the glazing 6, the profile piece 31 being designed fork-like towards the glazing 6. Inside the fork profile, a marginal web 32 extends, which is molded on the supporting leg 13. The cover frame 42 circumferentially is formed in one piece and is slightly oversized with respect to the glazing cut-out 41. As shown in FIG. 4, the edge 40 defining the glazing cut-out 41 extends without being angled, i.e. substantially parallel to the glazing plane. The cover frame 42 has a circumferential groove, with which it can be plugged onto the edge 40 by elastically deforming the cover frame 42, so that said edge is enclosed on both sides. By means of the cover frame 42, there is in particular also compensated the curvature of the metal casing towards the glazing as shown in FIG. 2. As a result of the curvature of the metal casing, the distance of the edge 40 from the glazing plane is changed. The cover frame 42 has a depth which changes along the length of the transverse legs 11, i.e. its rear side, which faces the glazing, forms a planar surface, whereby a gap between the glazing and the corresponding leg of the profile piece 31 is minimized. By means of the one-piece cover frame 42, which circumferentially rests against the edge 40 of the metal casing 7, a sharp precise optical appearance can be achieved. In particular, the missing bend of the edge 40 can provide for a sharp-edged, angular formation of the glazing cut-out 41.

In the embodiment as shown in FIG. 4, the compensation of tolerances for the glazing 6 is shifted to the rear, so to speak, i.e. to the inside of the door. On the rear side, the glazing 6 is held in the glazing holder 12 by a circumferential seal 33. As shown in FIG. 4, the seal 33 is engageable in the glazing holder 12 and covers the edge of the glazing 6. The circumferential seal 33 advantageously is injection molded or coextruded from different plastic materials by a two-component method. In particular, the seal 33 can have an elastic sealing lip 43, which is molded on a stiffer fastening portion 44. In the illustrated embodiment, the stiffer fastening portion 44 is provided with an engagement arm, by means of which the seal 33 can be brought in engagement with the glazing holder 12. By means of the elastic sealing lip 43, the compensation of tolerances necessary for the glazing 6 is ensured. When the thickness of the glazing is increased during a decrease in pressure, the sealing lip 43 will give way correspondingly.

In the embodiment as shown in FIG. 4, the metal casing 7 also is foam-filled on the side of the rear wall. In the resulting foam body 19, the glazing holder 12 is foamed-in.

By means of the continuous metal casing 7, a homogeneous and noble optical appearance is achieved on the visible surface, which now consists of a completely uniformly colored and aligned material. Color deviations, visible formation of gaps or points of abutment are thereby excluded. In addition, there is a possibility for printing, painting or thermosublimation, whereby the visible surface of the metal frame can be adapted to the specific wishes of the customer. The color of the glass door can of course also be adapted to the apparatus body 2, which so far has only been possible to a restricted extent due to the different materials used.

The invention claimed is:

1. A refrigerator and/or freezer with a glass door (3) having a metal frame (5) in which a glazing (6) is inserted, wherein the metal frame (5) forms an outer skin and the visible sides of the door (3) including front and outer circumferential sides thereof, with a front-side portion (16) and a narrow-side portion (17) covering the front and circumferential sides of the glazing (6), a circumferential glazing holder (12) being connected with the outer skin (7), the outer skin 7 is composed of a circumferentially integral one-piece metal casing (7) on all sides of the glazing (6) when viewed from the front side of the door (3), which on the visible sides of the door (3) is formed without a seam on all sides of the glazing (6), the glazing holder (12) on all outer circumferential sides is foamed into a circumferential foam body (19) to form a single piece and with which the metal casing (7) is circumferentially foam-backed on its entire rear side, and said one-piece metal casing (7) covers the foam body (19) on at least three sides, including front (16), outer circumferential (17) and back (18) sides.

2. The refrigerator and/or freezer as claimed in claim 1, wherein the metal casing (7) is bulged on the front-side portion (17) across the width and/or height of the door.

3. The refrigerator and/or freezer as claimed in claim 2, wherein the metal casing (7) is composed of a formed sheet profile, in particular is deep-drawn and/or bent and beaded.

4. The refrigerator and/or freezer as claimed in claim 3, wherein the front side of an upper and/or lower transverse leg (11) of the metal casing (7) has a curvature in longitudinal direction of this upper and/or lower transverse leg (11).

5. The refrigerator and/or freezer as claimed in claim 1, wherein the metal casing (7) has a glazing cut-out (41) in which a circumferential one-piece cover frame (42) is inserted.

6. The refrigerator and/or freezer as claimed in claim 5, wherein the cover frame (42) circumferentially rests against the edge (40) of the metal casing (7) defining the glazing cut-out (41), in particular with a circumferential groove can be plugged onto this edge which preferably extends approximately parallel to the glazing plane, so that the edge (40) is enclosed by the cover frame (42) on both sides.

7. The refrigerator and/or freezer as claimed in claim 5, wherein the cover frame (42) has a changing depth which compensates the curvature of the front side of the metal casing (7) towards the glazing (6).

8. The refrigerator and/or freezer as claimed in claim 1, wherein the metal casing (7) has an angular glazing cut-out (41).

9. The refrigerator and/or freezer as claimed in claim 1, wherein the glazing holder (12) has a supporting leg (13) protruding to the inside from the metal frame (5), on which supporting leg the glazing (6) rests and is adhered with its flat side.

10. The refrigerator and/or freezer as claimed in claim 1, wherein the glazing (6) is a multiple glazing, in which a plurality of glass panes (21, 22, 23) are arranged at a distance from each other and connected with each other by spacers (24, 25).

11. The refrigerator and/or freezer as claimed in claim 1, wherein between the metal casing (7) and the glazing (6) and/or between the glazing holder (12) and the glazing (6) a seal (27, 28), in particular an elastic lip seal, is provided.

12. The refrigerator and/or freezer as claimed in claim 1, wherein the glazing (6) is supported by an elastic seal (33), which encloses the glazing (6) and provides for a compensation of tolerances for the glazing.

13. The refrigerator and/or freezer as claimed in claim 12, wherein the elastic seal (33) is disposed on the inner door side of the glazing (6).

14. The refrigerator and/or freezer as claimed in claim 12, wherein the seal (33) has portions of different hardness and/or flexibility, in particular a soft sealing lip which is molded on a harder fastening portion.

15. The refrigerator and/or freezer as claimed in claim 14, wherein the seal (33) is injection-molded or coextruded from different materials by a two-component method.

16. The refrigerator and/or freezer as claimed in claim 1, wherein towards the glazing cut-out (41) the metal casing (7) has a marginal web (40) which is angled with respect to the front side of the metal casing (7).

17. The refrigerator and/or freezer as claimed in claim 16, wherein the elastic seal is seated on the marginal web (40).

18. The refrigerator and/or freezer as claimed in claim 1, wherein an additional application, in particular a heating, an illumination means, a thermometer (8) or the like, is provided on the metal frame (5) between the metal casing (7) and the glazing (6).

19. The refrigerator and/or freezer as claimed in claim 1, wherein an illumination means (15) for illuminating the glazing (6) is provided on the metal frame (5).

20. The refrigerator and/or freezer as claimed in claim 6, wherein the cover frame (42) has a changing depth which compensates the curvature of the front side of the metal casing (7) towards the glazing (6).

* * * * *